United States Patent [19]

Reyes et al.

[11] 4,212,007

[45] Jul. 8, 1980

[54] COMBINED BURGLAR FRIGHTENING DEVICE AND ALARM

[76] Inventors: Daniel Reyes, c/o George Spector 3615 Woolworth Bldg., 233 Broadway; George Spector, 3615 Woolworth Bldg., 233 Broadway, both of New York, N.Y. 10007

[21] Appl. No.: 728,434

[22] Filed: Sep. 30, 1976

[51] Int. Cl.[2] ..... G08B 13/08

[52] U.S. Cl. ..... 340/691; 40/414; 340/545; 340/692

[58] Field of Search ..... 340/221, 274 R, 276, 340/691, 545, 692, 541; 40/126 B, 106.52, 106.3, 414, 416, 411

[56] References Cited

U.S. PATENT DOCUMENTS

| | | | |
|---|---|---|---|
| 1,167,502 | 1/1916 | Huffman et al. | 40/411 |
| 1,577,903 | 3/1926 | Gover et al. | 40/106.3 |
| 2,599,623 | 6/1952 | Forrester | 340/276 |
| 3,735,514 | 5/1973 | Asder | 40/411 |
| 3,740,737 | 6/1973 | Carleson | 340/221 |
| 3,750,132 | 7/1973 | Natter | 340/309.1 |

*Primary Examiner*—Glen R. Swann, III

[57] ABSTRACT

An electric circuit is automatically activated by the unauthorized opening of a door, window, etc., whereby an alarm buzzer and light are actuated simultaneously with a dog simulating device which simulates the actions and sounds of a dog about to attack.

4 Claims, 5 Drawing Figures

COMBINED BURGLAR FRIGHTENING DEVICE AND ALARM

BACKGROUND OF THE INVENTION

This invention relates generally to burglar alarms.

It is well known that many burglar alarms have been developed and marketed but which are not ideal, because while they satisfactorily warn the owner or police that a burglar has entered a premises to commit a robbery, the robber, moving quickly can, accomplish the theft and be gone before the owner or police arrive at the scene, thus resulting in the loss of possessions anyway in spite of being protected by a burglar alarm. This situation is accordingly in want of an improvement.

BRIEF SUMMARY OF THE INVENTION

Therefore, it is an object of the present invention to provide a burglar alarm that in addition to giving a warning to an owner or police also warns the prospective robber that he is in physical danger if he proceeds further with the robbery and thus discourages him from accomplishing the proposed theft.

Another object is to provide a burglar alarm that would be particularly ideal to protect a home, a factory or other premises.

Other objects are to provide a Mini Burglar Alarm which is simple in design, inexpensive to manufacture, rugged in construction, easy to use and efficient in operation.

These and other objects will be readily evident upon a study of the following specification and the accompanying drawing wherein:

DESCRIPTION OF THE PREFERRED EMBODIMENT

Figure 1:
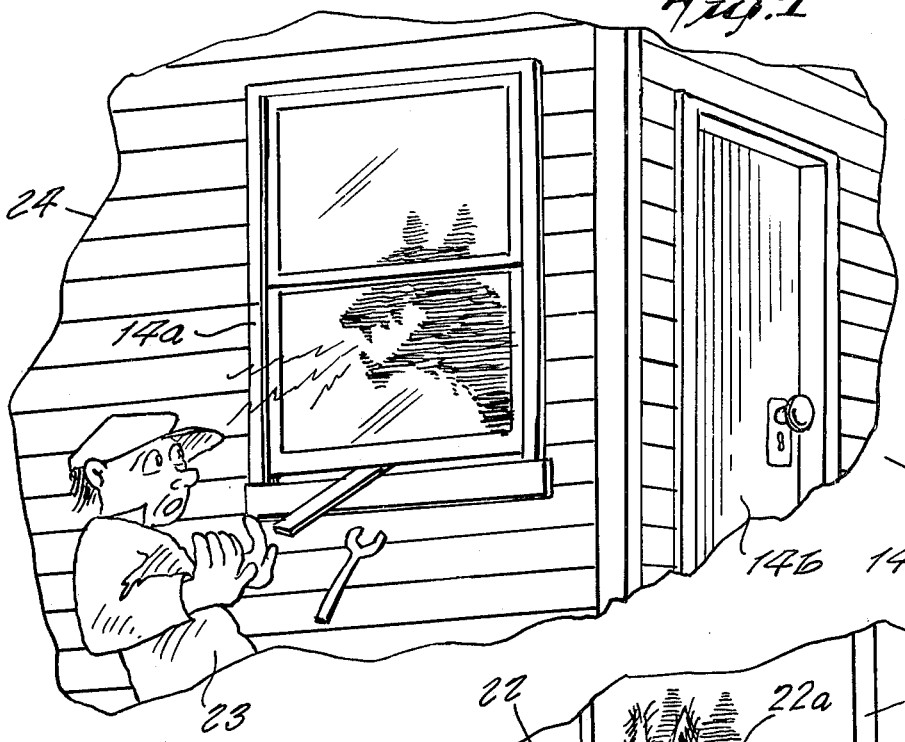
FIG. 1 is a view of the operational effect of the invention to frighten away a burglar.
Figure 2:
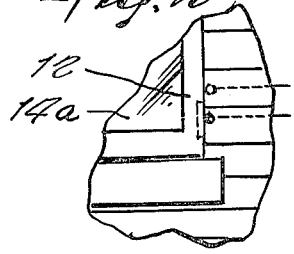
FIG. 2 is a detail of the window switch.
Figure 3:
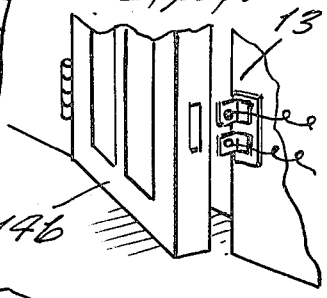
FIG. 3 is a detail of the door switch.
Figure 4:
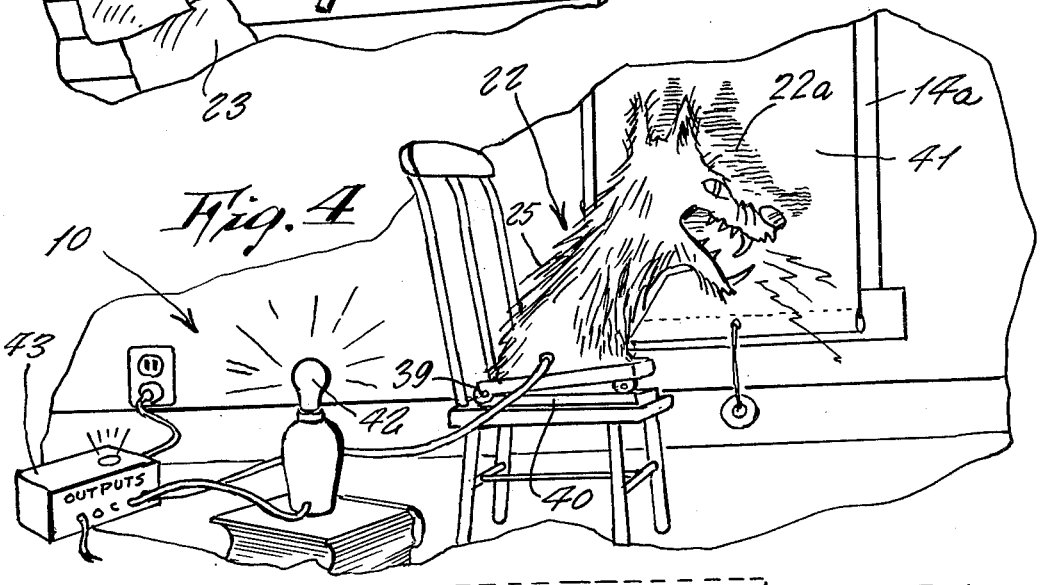
FIG. 4 is a view of the invention set up for protection of a house.
Figure 5:
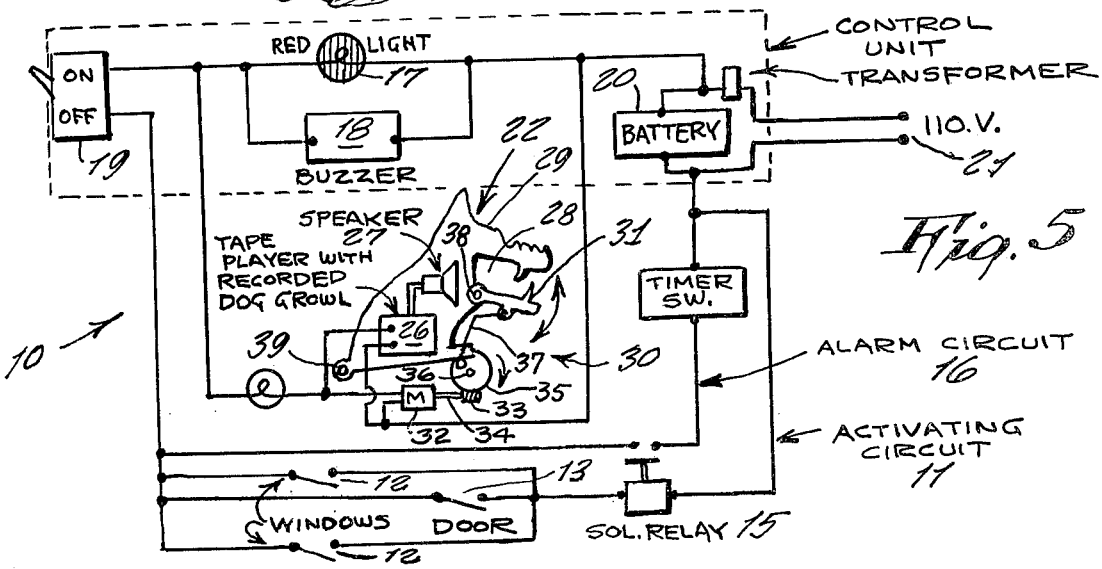
FIG. 5 is an electric circuit of the invention.

Referring now to the drawing in greater detail, the reference numeral 10 (FIGS. 4 & 5) represents a burglar alarm according to the present invention wherein the same includes an activating electric circuit 11 (FIG. 5) having switches 12 and 13 located at windows 14a and doors 14b respectively (FIGS. 1–4) so that if they are opened, the activating circuit activates a solenoid relay 15 that closes an alarm circuit 16 which includes a visually warning lamp 17 and a buzzer or bell 18 so to notify an owner or police that the windows or doors have been opened (FIG. 5).

Both circuits 11 and 16 are connected to a manually operated switch 19 so that a person can selectively shut off the system when opening the doors and windows himself. Both circuits 11 and 16 are electrically powered by both a dry cell battery 20 and house electricity 21 so that in case a suspicious burglar cuts the house electric wires in advance, suspecting that there may be an electrically operated burglar alarm, the battery in such case will still set off the device.

In the present invention, the alarm circuit 16 also includes a dog-shaped device 22 to fool the burglar 23 into believing that a premises or house 24 is guarded by a watch dog. The device 22 is made to resemble particularly a large and fierce dog that would attack an intruder. The device 22 is covered by fur 25 and may resemble either a full dog or at least only the head, neck and chest portion thereof as suggested in FIG. 4 of the drawing.

Within the interior of the device 22, there is a tape player 26 fitted with a tape having thereupon a recording of a barking and growling dog, the tape player being connected to a speaker 27 directed to emit sound out of an open mouth 28 of a head 29. The tape player as well as a mechanism 30 inside the device are connected to circuit 16. The mechanism 30 causes the lower jaw 31 of the mouth 28 to physically move during the barking and growling so to visually provide realism to the device 22. The mechanism 30 includes a motor 32 driving a worm 33 on motor shaft 34 to rotate a gear wheel 35 causing eccentric pin 36 to pull and push a rod 37 connected to jaw 31, so to cause the jaw to pivot about a pivot pin 38 stationarily mounted on the device 22. At a same time, the device 22 of FIG. 4 is completely pivotable about a hinge 39 attached to a base plate 40 that supports a shaft about which the gear wheel 35 rotates. The eccentric pin supports one end of the device 22 thereupon so that it causes the device 22 thus to pivot reciprocally up and down about the hinge 39. Additionally a similar mechanism may be employed to stretch longitudinally both upper and lower jaws of the mouth which are made of stretchable rubber covered by the fur 25, so to further increase the ferocious appearance of the device during operation.

In operative use, as shown in FIG. 4, the device 22 can be placed so a shadow 22A of the device falls on a pulled down window shade 41 so to be visible to the burglar outside of the house. A lamp 42 also in the alarm circuit throws the shadow on the shade.

It is further noted that Switch 19, buzzer 18, red light 17 and the battery 20 can be combined into a single unit such as 43 with battery 20 in an internal compartment so that the unit 43 can be located at a convenient operative position.

While various changes may be made in the detail construction, it is understood that such changes will be within the spirit and scope of the present invention, as is defined by the appended claims.

What is claimed is:

1. A burglar frightening device and alarm, comprising an electric circuit having a switch normally maintained in open position by contact with a closure to a building access opening, said switch being biased to a closed position whereby upon opening of said closure, said switch moves to the closed position to activate said circuit, including an alarm and animal simulating mechanism electrically connected to said circuit, wherein said mechanism includes means for simulating movements and sounds emitted by an animal about to attack, whereby opening movement of the closure results in actuation of both said alarm and mechanism.

2. The combination of claim 1 including a solenoid relay for closing said alarm circuit responsive to closing of said switch.

3. The combination of claim 2 wherein said means includes the head of an animal having a mouth with a movable jaw and a speaker located in said mouth, further including a tape recording of desired sounds of an animal, wherein said recording and speaker are electrically connected to said circuit whereby activation of said circuit causes said jaw to move and the emission of animal sounds from said mouth.

4. The combination of claim 3 further including a second means for moving the entire mechanism up and down.

* * * * *